United States Patent [19]

Beavers et al.

[11] Patent Number: 5,052,367

[45] Date of Patent: Oct. 1, 1991

[54] VENTILATING HEATER

[76] Inventors: Allan E. Beavers, 638 S. Surrey Ct., Grand Junction, Colo. 81401; Robert A. Fulcher, 3329 N. Ridge Dr., Grand Junction, Colo. 81506

[21] Appl. No.: 545,349

[22] Filed: Jun. 27, 1990

[51] Int. Cl.[5] ..... F24H 3/02

[52] U.S. Cl. ..... 126/110 B; 126/116 A; 126/116 R

[58] Field of Search ..... 126/99 R, 110 R, 110 B, 126/110 C, 110 E, 110 D, 116 R, 92 AC, 114, 116 A, 116 B, 104 R, 109, 118; 415/222, 223; 237/12.1, 12.3 C

[56] References Cited

U.S. PATENT DOCUMENTS

| | | | |
|---|---|---|---|
| 2,540,280 | 2/1951 | Norman, Jr. | 126/110 B |
| 2,609,055 | 9/1952 | Monroe | 415/222 |
| 3,115,130 | 12/1963 | Seymour | 126/110 R |
| 4,390,125 | 6/1983 | Rozzi | 126/92 AC |
| 4,718,846 | 1/1988 | Oguri et al. | 126/92 AC |
| 4,729,365 | 3/1988 | Mutchler | 126/110 B |
| 4,941,863 | 7/1990 | Chou et al. | 126/110 B |

*Primary Examiner*—James C. Yeung
*Attorney, Agent, or Firm*—Donald W. Erickson

[57] ABSTRACT

An easily portable ventilating heater to supply either ambient fresh air or warm fresh air to utility workers while working in an underground utility installation. The ventilating heater comprises a blower unit and a heater unit. The blower unit can be used and operated without the heater being in operation. On the other hand, the heater cannot operate unless the blower unit is in operation. The ventilating heater has seveal safety features so that the heater automatically shuts down if the heater exceeds a pre-set temperature of about 200° F., the inlet air flow is interrupted or the power or gas supply is interrupted. The ventilating heater automatically restarts once the heater temperature goes below the pre-set temperature and there is no interruption of air or gas flow or power. The heater uses liquid propane gas and the electrical system can be A.C. or D.C.

15 Claims, 6 Drawing Sheets

VENTILATING HEATER

BACKGROUND OF THE INVENTION

It is important that utility workers when working in underground utility installations have an efficient, safe and reliable source of fresh air and heat. Underground utility installations can be cold, damp and contain foul air capable of causing the worker to lose consciousness. Existing rules require that the workers purge the underground utility installation before entering it. The portable ventilating heater of the present invention performs the dual functions of providing fresh air and heat. The blower is operable independent of the heater and, therefore, can be used to purge and continue to supply fresh air to an underground utility installation. After purging the installation, if it is desired to introduce heated air, the heater is activated also.

SUMMARY OF THE INVENTION

The ventilating heater of the present invention comprises a highly efficient blower unit and heater unit. The ventilating heater is compact, lightweight and easily portable by one person. The heater is unusually efficient which is believed to be attributable to the unique design of the heat exchanger and burner as described in detail hereinafter. A safety feature of the heater is the design of the exhaust system of the heat exchanger which moves exhaust fumes away from the blower air inlet. The ventilating heater of the present invention contains several safety features. The heater unit is thermostatically controlled so that if the heater reaches about 200° F., the burner and liquid propane gas (LP) supply are shut down. This does not shut down the blower unit. Once the heater cools down, the LP supply is automatically resumed and the burner is automatically reignited. If the air flow from the blower is interrupted such as by accidental blockage of the air inlet or electric power failure, the burner and the LP supply are turned off. Once the air flow is resumed, the LP supply and burner are automatically re-activated. If the LP flow is interrupted, the heater shuts down but not the blower. The heater unit cannot function independent of the blower unit. Additional safety features and advantages of the ventilating heater of the present invention will be apparent as a preferred specific embodiment of the invention is hereinafter described in detail.

DETAILED DESCRIPTION OF THE INVENTION

Figure 1:
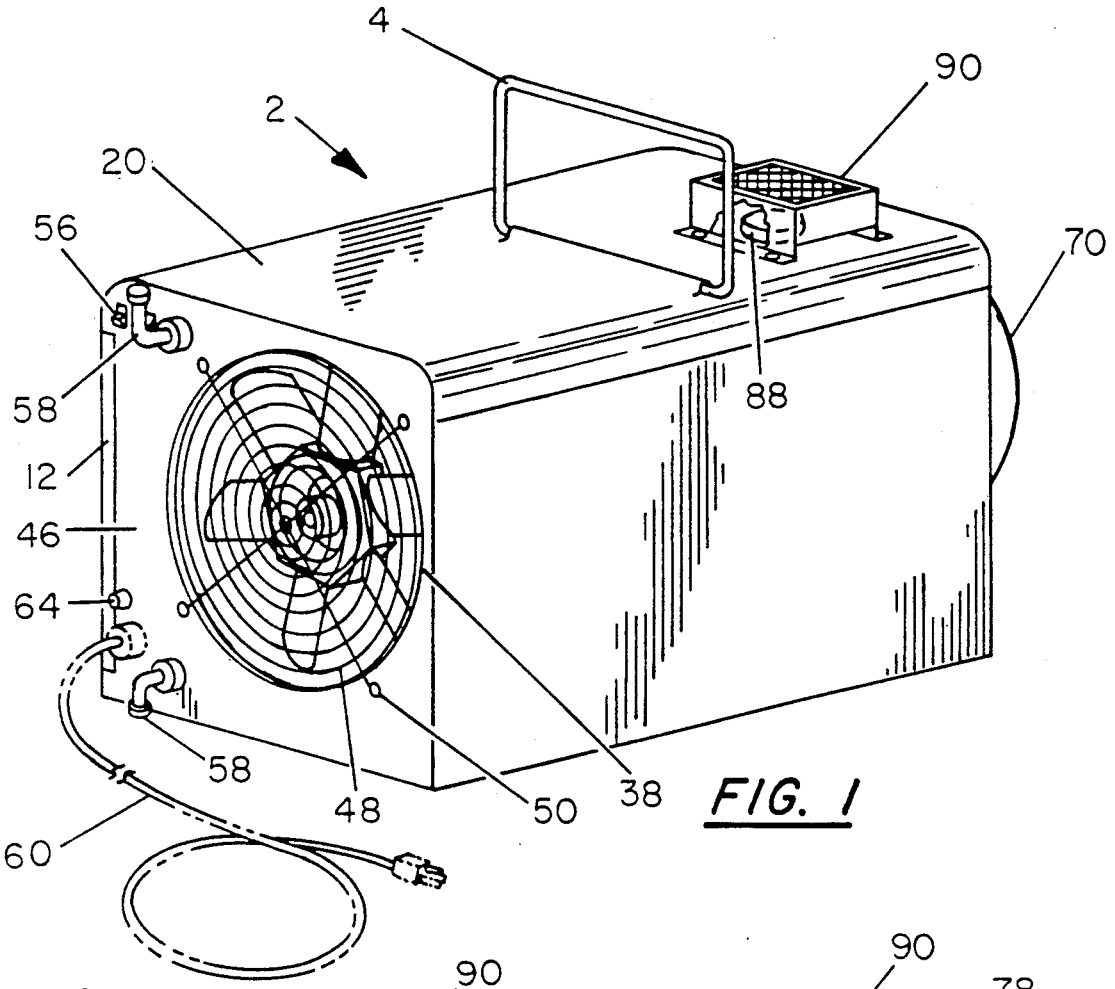
FIG. 1 is a perspective view of a ventilating heater in accordance with the present invention.
Figure 2:
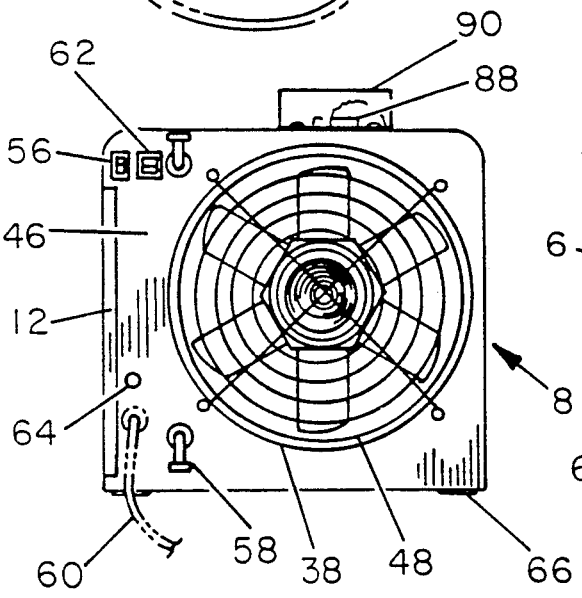
FIG. 2 is a front elevational view thereof.

Referring to FIG. 1, there is shown a perspective view of a ventilating heater 2 of the present invention having overall dimensions of about 24" length, 14" width and 16" height. The ventilating heater weighs only about 50lbs. and is easily portable by use of the foldable carrying handle 4. The heater 6 is fueled by LP and can generate about 66,000 BTUH and more. The axial blower 8 can be powered by a ⅓ HP AC motor, 115 VAC, 4 amp., 60 HZ or a ⅓ HP DC motor.

Figure 6:
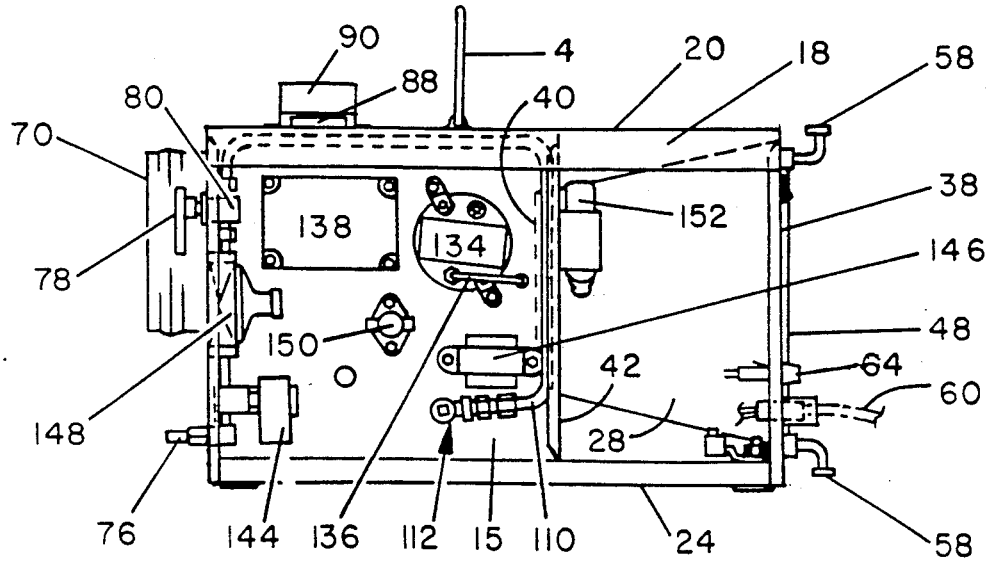
FIG. 6 is a side view, left side, with the side panel removed of the heater of FIG. 1.

The ventilating heater 2 has a light weight sheet steel housing and base with two readily removable panels. One easily removable panel is the left side panel 12 which permits easy access for servicing the control components mounted on partition 15 as shown in FIG. 6. Panel 12 is held in place by screws 16 and the overlapping lip 18 of the top panel 20. The second easily removable panel is panel 22 located on the base 24 which permits ready access for adjustment of the air intakes of the burner for setting an efficient air to fuel ratio. The panel is removed by unthreading screws 26. The top panel 20 can be removed for accessing the heater and blower but not as easily or readily as panels 12 and 22.

Figure 14:
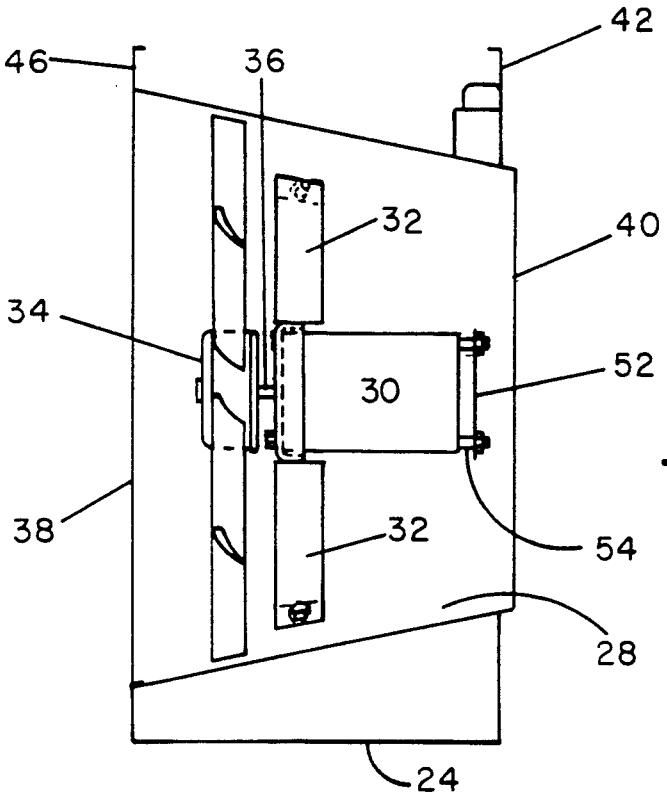
FIG. 14 is a cross-sectional view of the blower unit of FIG. 8.

The axial blower 8 comprises a cone shaped steel housing 28 in which the motor 30 is positioned centrally and held by motor mount 32. As shown in FIG. 14, the rear of the motor is provided with a heat shield comprising an aluminium plate 52 and spacers 54 to protect the motor. The fan 34 (8" diameter) is securely mounted on motor shaft 36. The air inlet 38 of the blower housing has a diameter of about 10½" and tapers to an outlet 40 of a diameter of about 8". The outlet extends slightly through and is attached, as by spot welding, to inner wall partition 42 of the heater compartment 44. The air inlet 38 is attached to and supported by front panel 46. The length of the blower housing, along its central axis, is about 8½". An inlet wire guard 48, attached to the front panel by screws 50, covers the inlet opening and provides protection for the worker and the blower. The axial blower is turned off and on using the 16 amp. lighted rocker switch 56 mounted in the upper left corner of the front panel. Also, attached to the front panel are two storage bolts 58 for storage of the power cord 60 when it is not in use. Adjacent to blower switch 56 and attached to the front panel is a 29 amp. lighted rocker switch 62 for turning off and on the heater electrical system. Also, mounted in the front panel is a fuse holder 64 which contains 1.0 amp. fuse as a safety feature for the heater electrical system. Attached to partition 42, near the top thereof, is capacitor 152. A suitable capacitor is a 7.5MFO, 370VAC of Capacitor Corp., Winooski, VT.

The base 24 is provided near each corner thereof with a resilient, solid rubber foot 66 for shock protection, stabililty and to provide an air space under the ventilating heater.

Figure 3:
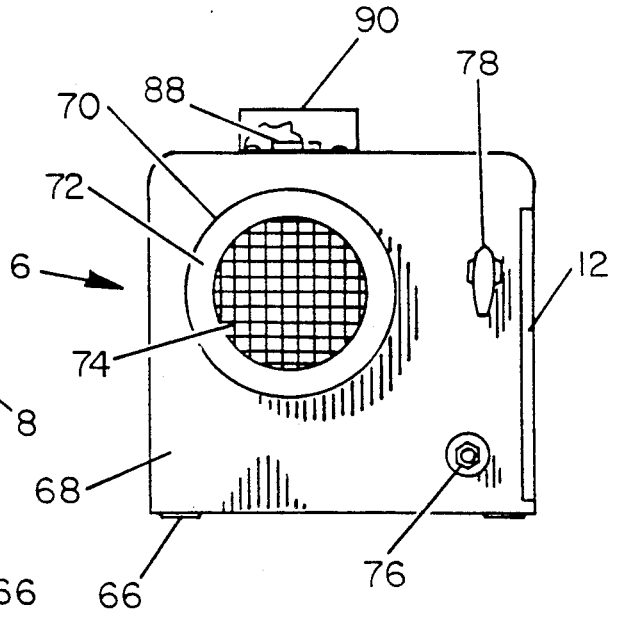
FIG. 3 is a rear elevational view thereof.
Figure 4:
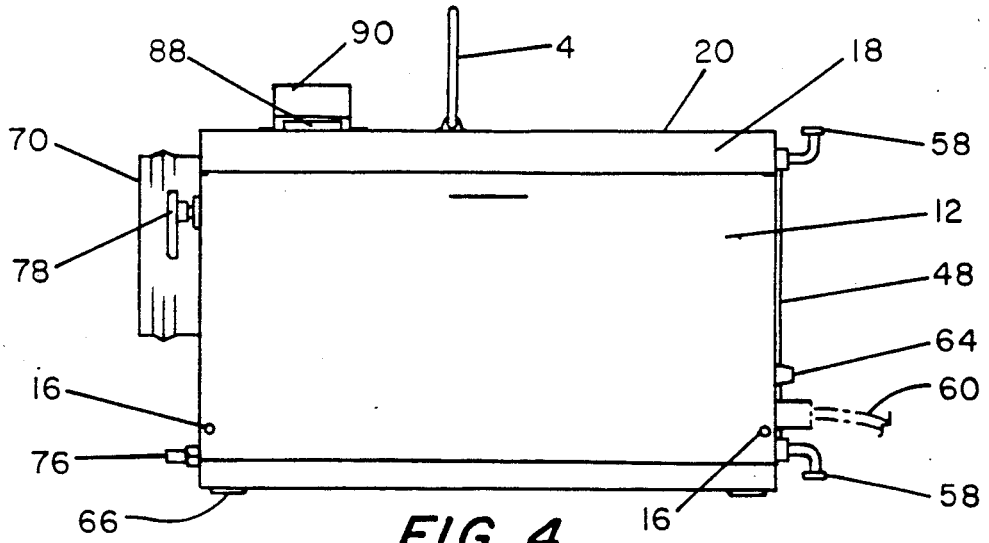
FIG. 4 is a side elevation of the left side of the heater of FIG. 1.
Figure 5:
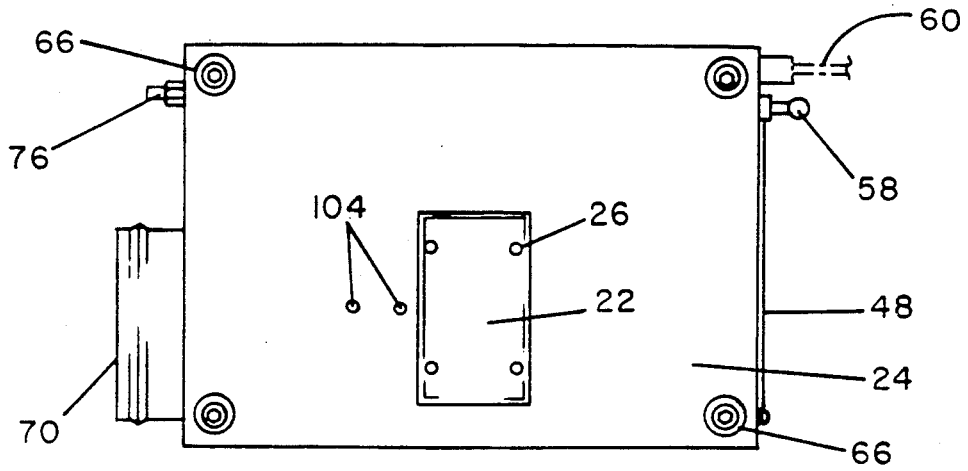
FIG. 5 is a bottom plan view thereof.

Located in the rear panel 68 and in communication with the heater compartment 44 is a warm air outlet 70 having a diameter of about 8". The diameter of the outlet is suited to receive an 8" blower hose, not shown, for delivery of the warm fresh air via a manhole into an underground utility installation or other area to be heated and ventilated. As best seen in FIG. 3, the passage of outlet 70 is constricted internally by circular plate 72 so that the effective air outlet is reduced to an opening having a diameter of about 4⅞". The opening is covered by wire guard 74 for safety. By having the constriction in the heater air outlet passage, recalling that the air outlet of the blower is about 8", there occurs some pressurization of the air in the heater compartment with the result that the air is heated more efficiently and to a higher temperature as compared to a system having an outlet passage with no constriction. The outlet 70 protrudes from the rear panel about 2" and has a flange to facilitate attachment of a blower hose. If it is desired to have greater air flow, the constriction in the outlet can be reduced or eliminated entirely, especially during the warmer months of the year. Also, attached to the rear panel are the LP input adapter 76 to which the supply of LP is connected and valve handle 78 for controlling ball valve 80 and, hence, the rate of flow of the LP to the burner.

Referring to FIGs. 7–13, within heater compartment 44 is positioned the heat exchanger 82 to which, at the base thereof, is attached the burner box 84, which, in turn, receives the burner unit 86. The heat exchanger, at the top and near the rear edge thereof, as part of the exhaust system has an exhaust or chimney pipe 88 (diameter of about 2½") which is fitted with a chimney cap 90. The pipe extends through the top panel 24 about 1". It is important to note that exhaust pipe 88 is located at the rear, as shown, of the heat exchanger 82. This design moves exhaust fumes away from the blower air inlet. Also, positioned within heater compartment 44 are two aluminum side wall insulation panels 92 held in place by clips 94, see FIG. 7, for protection of the worker and the control components mounted on partition 15.

Figure 9:
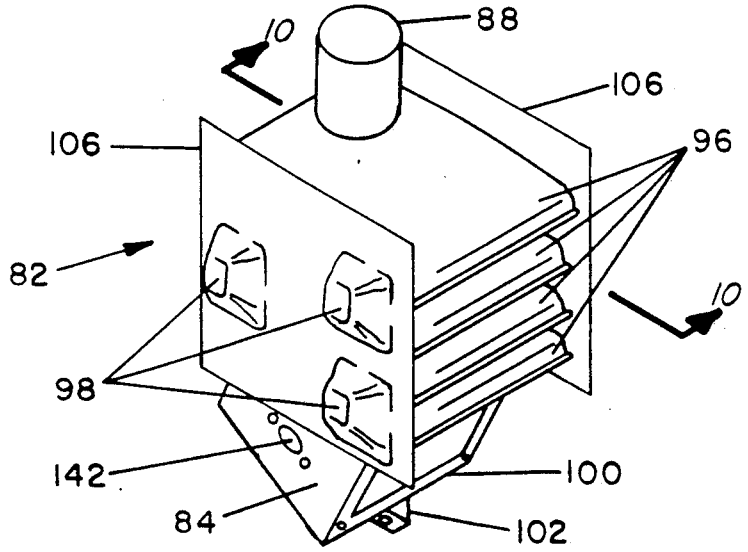
FIG. 9 is a perspective view of the heat exchanger and burner box of the heater of FIG. 1.
Figure 10:
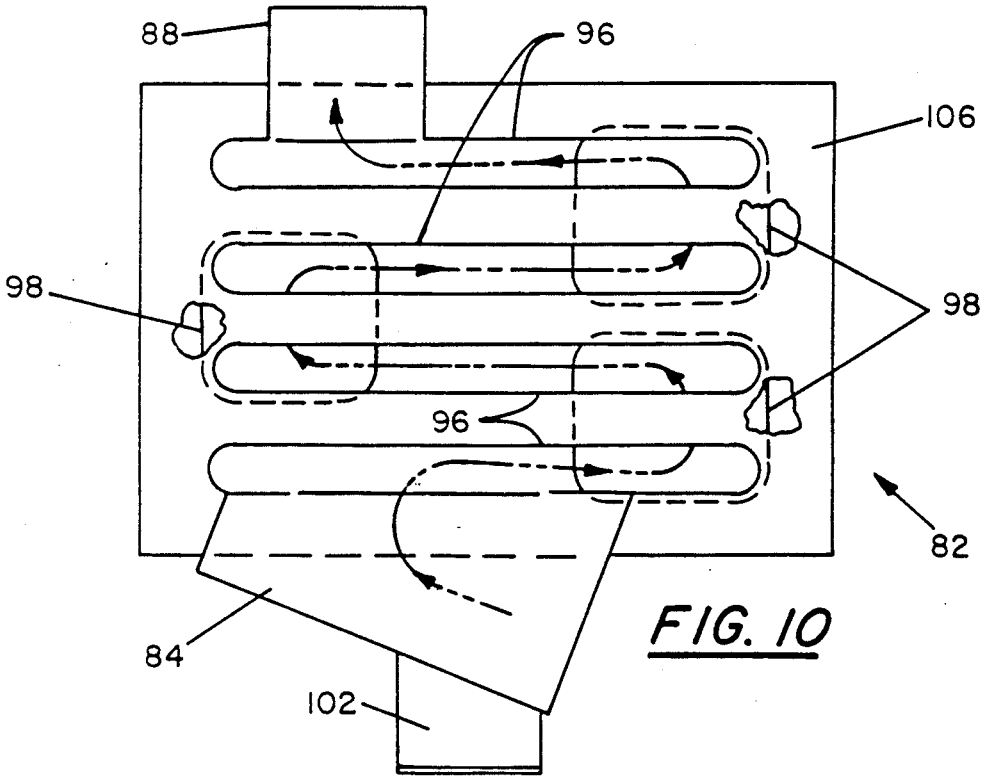
FIG. 10 is an enlarged cross-sectional view along line 10—10 of the heat exchanger and burner box of FIG. 9.
Figure 11:
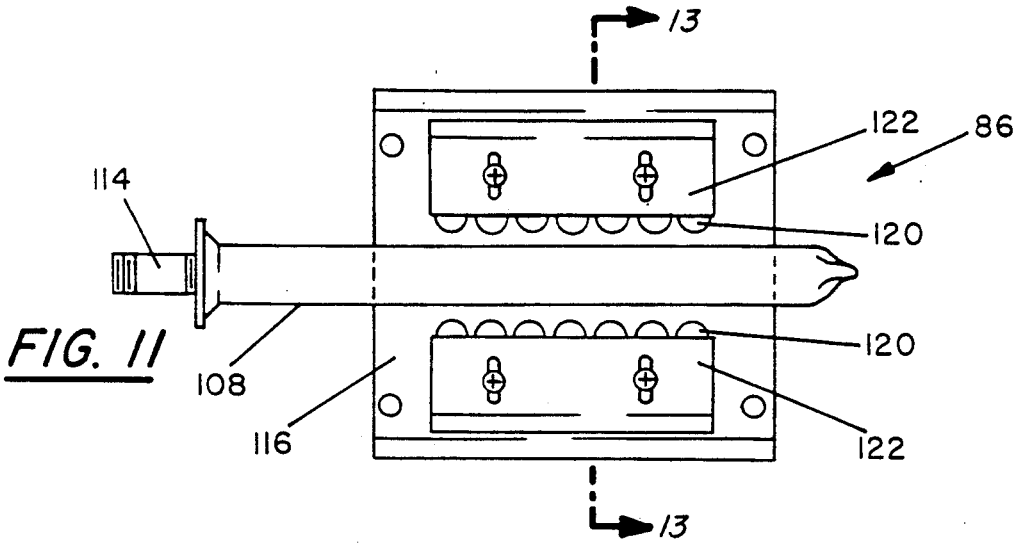
FIG. 11 is a front elevational view of the burner unit.
Figure 12:
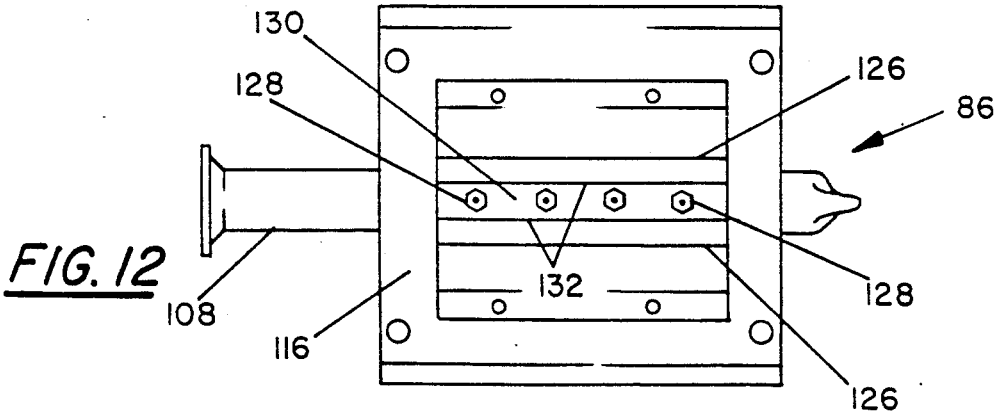
FIG. 12 is a rear elevational view of the burner unit.

Referring to FIGS. 9 and 10, the heat exchanger 82 is of generally rectangular configuration and, in the embodiment shown, has overall dimensions of about 10½" length, 8" height, and width 6". It is constructed of 22 gauge aluminized steel for superior heat transfer and long life. The heat exchanger has a plurality of combustion chambers 96, which provide a heat flow path shown by the broken lines in FIG. 10. The chambers are in heat flow communication via the generally pyramid shaped hollow members 98 positioned at the side of and at alternating ends of the chambers 96. In this way, an essentially symmetrical flow path is achieved giving efficient heating and combustion. Each hollow combustion chamber 96 has an overall dimension of about 9" length, 13/16" height, and 6" width. The chambers are spaced, on center, about 1¾". The chambers are welded to side walls 106 of the heat exchanger. The heat exchanger, including burner box 84, is supported by and attached to base 24 by supporting bracket 102 which is bolted to the base by bolts 104. The burner box is made of aluminized steel also. It has overall dimensions of about 6¾" length and 5¼" width for the bottom wall, about 4" height and 5¼" width for the front wall with an opening of 3" by 4¼" for the burner, about 2" height and 5¼" width for the rear wall, and about 7" length and 5¼" width for the top wall. In the top wall, there is a cut out of about 5¾" by 4¼", toward the rear thereof, which matches up with a similar or corresponding cut out in the bottom wall of the bottom combustion chamber, see FIG. 10. The burner box is welded to the bottom of the heat exchanger.

Figure 13:
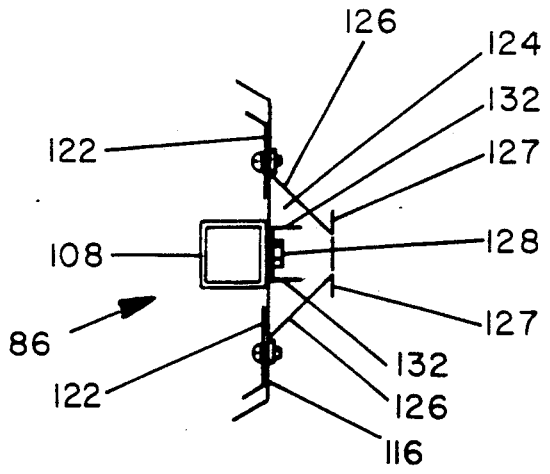
FIG. 13 is a cross-sectional along line 13—13 of FIG. 11.

The burner unit 86, FIGS. 8 and 11–13, is attached to the face 100 and extends into the interior of the burner box 84. The burner includes a gas inlet 108 which is mounted on the burner plate and threadly connected to gas supply line 110 via tee assembly 112 and nipple 114. The gas line is ¼" copper tubing. The gas inlet is attached to the generally rectangular burner plate 116 which is attached by screws 118 to the face of the burner box. The burner plate is provided with a plurality of air inlets 120 (diameter of about ½"), the openings or area of which can be adjusted by a change of the position of the slidable air adjustment plates 122. The adjustment plates are easily accessed through removal of panel 22 in the base. The burner air inlets are reduced at or about sea level and increased for higher altitudes in order to obtain a fuel efficient mixture of air and gas. Attached to the back of plate 116 is an elongated generally triangular shaped air-gas mixing chamber 124 which is in air and gas communication with air inlets 120 and a plurality of gas orifices 128 which are threadedly connected to and communicate with the open interior of gas inlet 108. The chamber 124 is defined by walls 126 as best seen in FIG. 13. Each wall 126 is at about a 45° angle relative to plate 116. The wall has a width of about 1" and a length of about 3⅞". The space between where the bases of walls 126 are attached to plate 116 is about 1½. The leg members 127 of walls 126 assist in providing a better flame. Within chamber 124 and through which orifices 128 project is an elongated generally U-shaped member 130 defined by walls 132, extending generally perpendicularly out from the rear of plate 116. The purpose of member 130 is to diffuse the LP gas from orifices 128 and thereby obtain an efficient and uniform mixture of gas and air.

The presence of U-shaped member 130 is important. If member 130 is not present, the flame burns back and you get undesirable flame impingement on the rear surface of plate 116. The orifice 128 positioned at the far left side of FIG. 12 has an opening slightly larger than that of the other orifices. One purpose of the larger opening is to ensure ignition of the burner by the automatic igniter/sensor 140. In addition, the ignition/sensor tip must always be surrounded by the flame or the system will shut down. The orifices are ¼" by 28 thread. The orifice for the ignitor/sensor is a No. 54 and the other orifices are No. 56 of Anderson & Forrester Corp., Golden, CO.

Figure 7:
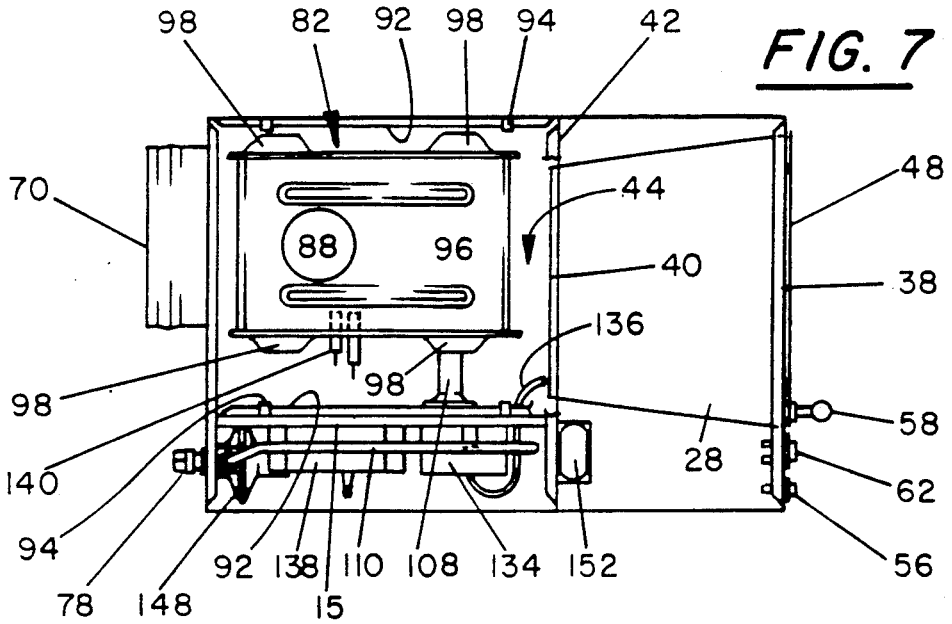
FIG. 7 is a top view thereof with the top panel removed.
Figure 8:
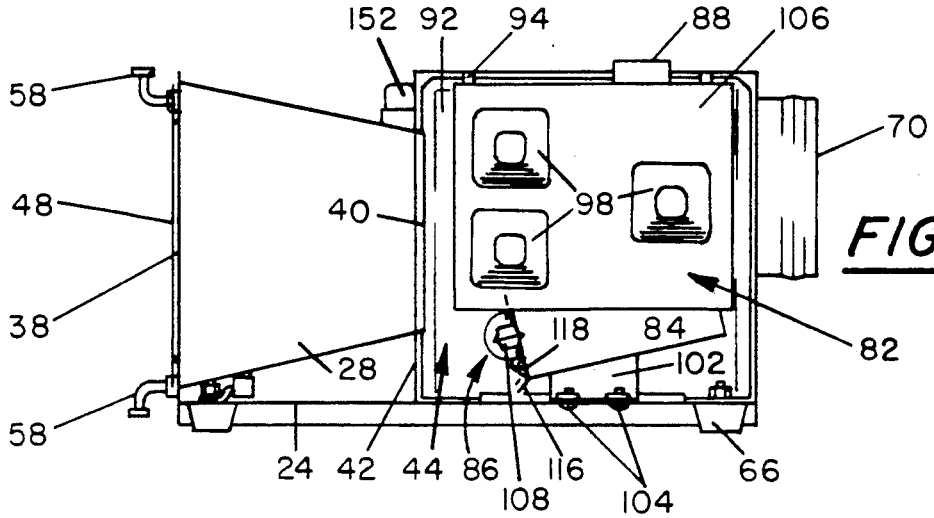
FIG. 8 is a side view thereof, right side, with the side and top panels removed.

The axial air blower 8 is activated by lighted rocker switch 56 and it can be operated independent of the heater. Thus, the user can use the blower for a supply of unheated air and also to cool down the heat exchanger after use. On the otherhand, the heater cannot operate independent of the blower. If there is no air flow detected by air switch 134 as supplied by air switch tube 136, the automatic controller 138 will not permit the spark igniter/sensor 140 to operate. The spark igniter/sensor is mounted on the side wall of burner box 84 and extends into chamber 124 of the box through hole 142 (FIGS. 7 and 9). If the heater is in operation and the air flow is interrupted, solenoid valve 144 is activated and shuts off the supply of LP and the burner. Similarly, if the LP flow or current is interrupted, the burner is automatically shut off. The air switch 134 is a Dwyer switch No. 26-114030-10 of Dwyer Instruments, Michigan City, IN. The automatic controller 138 is model No. 05-296426-753 of Fenwal Corp., Ashland, MA. The ignitier/sensor is model No. 5-100000-411 of Fenwal Corp. A suitable solenoid valve is model No. 04F20C 1108ACF of Fluidex Div., Parker Hannifin Corp., Madison, MS.

The heater is thermostatically controlled at a setting of about 200° F. by thermal switch 150. If the heater gets above 200° F., the thermostat opens and the heater shuts down. Once the heater cools below about 200° F., the electronic control system automatically re-ignites the burner. The thermal switch is model No. 2E253A of Grainger, Inc., Denver, CO.

In operating the ventilating heater, switch 56 is pressed to the on position to turn on the blower, then valve handle 78 is turned to the fully open or high position to supply LP, then heater switch 58 is pressed to the on position which charges transformer 146 to open solenoid valve 144 and permit flow of LP to pressure regulator 148 and then to the burner, electronic controller 138 and spark igniter/sensor 140 automatically ignite the burner, and then gas valve 80, after about 5 minutes, is adjusted to the desired heat level. A suitable transformer in model No. AT 140B of Valley Control Corp., Grand Junction, CO.

Figure 15:
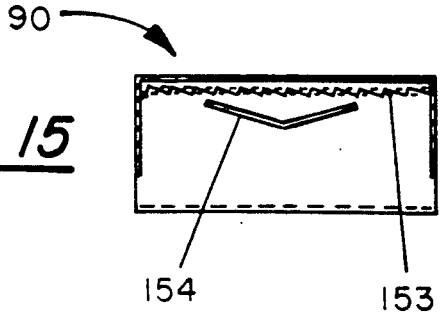
FIG. 15 is a cross-sectional view of the chimney cap.
Figure 16:
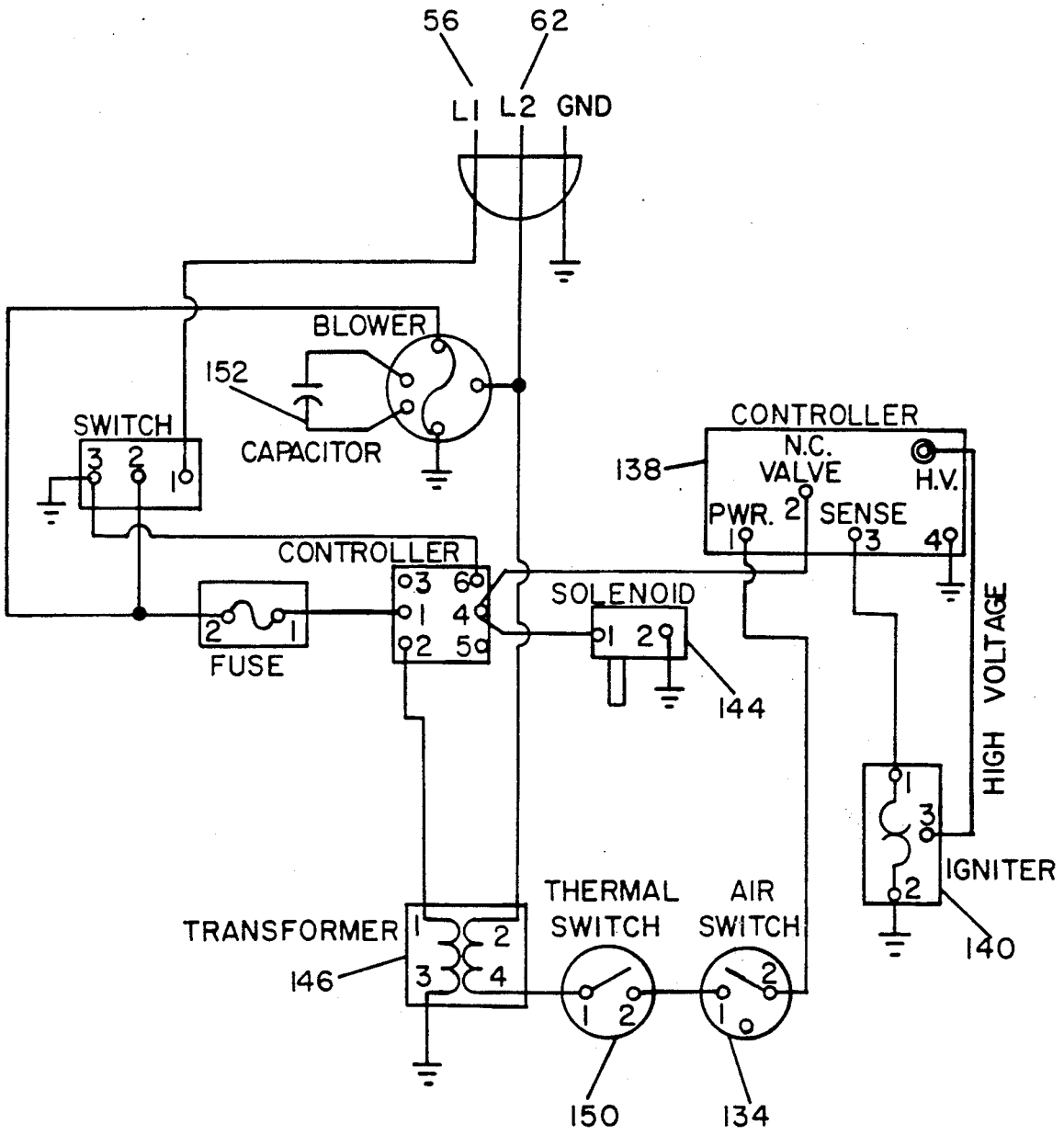
FIG. 16 is a schematic of the electrical system.

Referring to FIG. 15, the chimney cap 90 is provided with a metal screen 153 and a metal V-channel member 154 running the length of the cap. The screen provides protection from foreign objects getting into the combustion chambers 96. The V-channel member, and the screen also, and in dispersing the exhaust fumes and directing the fumes away from the blower air inlet. The cap and burner unit are made of steel.

The several dimensions, materials and components described herein are given for the purpose of illustrating the practice of the invention and not as a limitation thereof.

What is claimed is:

1. A portable ventilating heater comprising:

a light weight sheet metal housing of rectangular shape, said housing having a blower compartment as the front portion thereof, and adjacent heater compartment as the rear portion thereof, said blower compartment having air inlet in the front thereof and air outlet in the rear thereof which is in air passage communication with the heater compartment and said heater compartment having an air outlet in the rear thereof;

an axial air blower positioned in said blower compartment, said blower having a fan and electric motor to drive the fan and a generally cone shaped blower housing surrounding and supporting the motor and fan, the front end of said blower housing defining said air inlet and the rear end thereof defining said air outlet which is in air passage communication with said heater comprising;

a heat exchanger positioned in said heater compartment, said heat exchanger having an inlet at the base thereof to receive combustion fumes and an outlet at the top thereof to exhaust combustion fumes;

a burner box adapted to receive a burner unit, said burner being fueled by liquid propane gas, said burner box having an opening therein which is in combustion fume passage communication with the inlet of the heat exchanger and means for electrically igniting the burner unit;

means for supplying and controlling the flow of gas to the burner unit; and means for operation of the air blower independent of the burner unit.

2. A ventilating heater according to claim 1 wherein there is provided means including a pre-set temperature thermostat which is responsive to the temperature of the heater compartment whereby the gas supply and burner unit are shut down if the pre-set temperature is exceeded.

3. A ventilating heater according to claim 2 wherein the pre-set temperature is about 200° F.

4. A ventilating heater according to claim 3 which includes means for automatically resuming gas flow and re-ignition of the burner after the pre-set temperature is less than about 200° F.

5. A ventilating heater according to claim 1 including means whereby the gas supply and burner are shut down if the air flow from the blower outlet is interrupted.

6. A ventilating heater according to claim 5 which includes means for automatically resuming gas flow and re-ignition of the burner after air flow from the blower is resumed.

7. A ventilating heater according to claim 1 which includes means to shut down the gas supply and burner if the supply of gas is interrupted or the electrical power for the blower or heater is interrupted.

8. A ventilating heater according to claim 7 which includes means for automatically resuming gas flow and re-ignition of the burner after the supply of gas is resumed and the electrical power for the heater and blower is resumed.

9. A ventilating heater according to claim 1 wherein there is provided means in said burner unit for adjusting the ratio of air to gas in order to obtain a fuel efficient mixture of air and gas.

10. A ventilating heater according to claim 1 in which the outlet of the heat exchanger is positioned near the rear edge thereof.

11. A portable ventilating heater comprising:

a lightweight sheet metal housing of rectangular shape, said housing having a blower compartment as the front portion thereof, an adjacent heater compartment as the rear portion thereof, said blower compartment having an air inlet in the front thereof and an air outlet in the rear thereof which is in air passage communication with the heater compartment and said heater compartment having an air outlet in the rear thereof;

an axial air blower positioned in said blower compartment, said blower having a fan and electric motor to drive the fan and a generally cone shaped blower housing surrounding and supporting the motor and fan, the front end of said blower housing defining said air inlet and the rear end thereof defining said air outlet which is in air passage communication with said heater compartment;

a heat exchanger positioned in said heater compartment, said heat exchanger having an inlet att the base thereof to receive combustion fumes and an outlet at the top thereof to exhaust combustion fumes;

a burner box adapted to receive a burner unit, said burner being fueled by liquid propane gas, said burner box having an opening therein which is in combustion fume passage communication with the inlet of the heat exchanger and means for electrically igniting the burner unit;

means for supplying and controlling the flow of gas to the burner unit;

means for operation of the air blower independent of the burner unit; and said sheet metal housing having first and second parallel side panels, a front panel and rear panel in parallel relationship, said front panel supporting the air inlet of said blower, said rear panel supporting the air outlet of the heater compartment and a top panel and a base panel in parallel relationship, said top panel having an opening adapted to receive the outlet of the heat exchanger, said base panel having an easily removable panel attached thereto, said removable panel being smaller than said base panel and providing easy access for adjusting the air to gas ratio to the burner unit.

12. A ventilating heater according to claim 11 wherein said first side panel is easily removable.

13. A ventilating heater according to claim 12 wherein said panel is releasably attached to the vertical edge of the rear panel and front panel.

14. A ventilating heater according to claim 11 having a partition between and parallel to said front and rear panels to define the heater compartment and the blower compartment, said partition being essentially the same size as the front and rear panels and having an air communicating opening therein adapted to receive and support the outlet end of the air blower housing.

15. A ventilating heater according to claim 14 wherein there is provided a partition running parallel to said first side panel and abutting the rear panel and the partition between the front and rear panels, said partition being sufficiently inset from the outer edges of the top and base panels to serve as a mounting panel for the automatic control components for the heater and blower.

* * * * *